US005112564A

United States Patent [19]

Bernardet et al.

[11] Patent Number: 5,112,564

[45] Date of Patent: May 12, 1992

[54] ION EXTRACTION AND ACCELERATION DEVICE FOR REDUCING THE RE-ACCELERATION OF SECONDARY ELECTRONS IN A HIGH-FLUX NEUTRON TUBE

[75] Inventors: Henri Bernardet, Saint-Michel sur Orge; Xavier L. M. Godechot, Yerres; Claude A. Lejeune, Gif/Yvette, all of France

[73] Assignee: U.S. Philips Corporation, New York, N.Y.

[21] Appl. No.: 416,891

[22] Filed: Oct. 4, 1989

[30] Foreign Application Priority Data

Oct. 7, 1988 [FR] France ..... 88 13186

[51] Int. Cl.[5] ..... H05H 3/06

[52] U.S. Cl. ..... 376/116; 376/114

[58] Field of Search ..... 376/114, 115, 116

[56] References Cited

U.S. PATENT DOCUMENTS

| | | | |
|---|---|---|---|
| 3,014,132 | 12/1961 | Goldie | 376/116 |
| 3,448,314 | 6/1969 | Bounden et al. | 376/114 |
| 4,529,571 | 7/1985 | Bacon et al. | 376/108 |

OTHER PUBLICATIONS

P. O. Hawkins, The Review of Scientific Instruments, Compact Pulsed Generator of Fast Neutrons, vol. 31, No. 3, Mar. 1960, pp. 241-248.

*Primary Examiner*—Deborah L. Kyle
*Assistant Examiner*—Richard W. Wendtland
*Attorney, Agent, or Firm*—Paul R. Miller

[57] ABSTRACT

A device is set forth for the extraction and acceleration of ions in a high flux sealed neutron tube containing a low-pressure gaseous deuterium-tritium mixture, where an ion source (12) supplies several ion beams (3*a*, 3*b*, . . . 3*e*) which are projected onto a target electrode (4) by means of an extraction and acceleration system in order to produce therein a fusion reaction which causes an emission of neutrons. In accordance with the invention, an additional electrode (13) is arranged in the vicinity of and downstream from the final acceleration electrode (2) in the tube space between the final acceleration electrode and the target, the acceleration electrode as well as the additional electrode being connected to a potential which is chosen with respect to that of the target so that the secondary electrons created by ionization of the gas along the path of the beams are repelled, thus enabling the length of the space to increased so as to achieve a substantial reduction of the non-uniformity of the ion bombardment on the target, thus increasing the service life of the tube.

7 Claims, 5 Drawing Sheets

ION EXTRACTION AND ACCELERATION DEVICE FOR REDUCING THE RE-ACCELERATION OF SECONDARY ELECTRONS IN A HIGH-FLUX NEUTRON TUBE

The invention relates to a device for extraction and acceleration of ions in a high-flux neutron tube containing a low-pressure gaseous deuterium-tritium mixture in which an ion source supplies one or more ion beams to be extracted and accelerated with a high energy while traversing an extraction and acceleration system in order to be projected onto a target electrode so as to produce therein a fusion reaction which causes an emission of neutrons.

BACKGROUND OF THE INVENTION

Neutron tubes of this kind are used in techniques for the examination of substances by means of fast, thermal, epithermal or cold neutrons neutronography, analysis by activation, analysis by spectrometry of inelastic diffusions or radiative captures, diffusion of neutrons, etc.

In order to make these nuclear techniques as effective as possible, longer tube service lives are required for the corresponding emission levels.

The fusion reaction $d(3_H 4_{He})n$ which supplies 14 MeV neutrons is most commonly used because of its large effective cross-section for comparatively low ion energies. However, regardless of the reaction used, the number of neutrons obtained per unit of charge in the beam always increases in proportion to the increase of energy of the ions directed towards a thick target, that is to say mainly beyond ion energies obtained in the sealed tubes available at present and which are powered by a high voltage not exceeding 250 kV.

Erosion of the target by ion bombardment is one of the principal factors restricting the service life of a neutron tube.

The erosion is a function of the chemical nature and the structure of the target, on the one hand, and of the energy of the incident ions and their density distribution profile on the surface of impact, on the other hand.

In most cases the target is formed by a hydride (titanium, scandium, zirconium, erbium, etc.) which hydride is capable of binding and releasing large quantities of hydrogen without substantially affecting its mechanical strength. The total quantity bound is a function of the temperature of the target and of the hydrogen pressure in the tube. The target materials used are deposited in the form of thin layers whose thickness is limited by the problems imposed by the adherence of the layer to its substrate. One way of retarding the erosion of the target, for example, is to construct the absorbing active layer as a stack of identical layers which are isolated from one another by a diffusion barrier. The thickness of each of the active layers is in the order of magnitude of the penetration depth of deuterium ions striking the target.

Another method of protecting the target, thus increasing the service life of the tube, consists in the influencing of the ion beam so as to improve its density distribution profile on the surface of impact. For a constant total ion current on the target electrode, leading to a constant neutron emission, this improvement will result from an as uniform as possible distribution of the current density across the entire target surface exposed to the ion bombardment.

One of the ways of reducing this maximum density is to use the divergence of the beam in the space between the point of convergence and the target. In this space any increase of the path of the ions by a factor x is translated into a reduction of the type $1/x^2$ of the maximum bombardment density.

In a sealed neutron tube the pressure of the deuterium-tritium mixture necessary for obtaining the ion current is of primary importance and is the same throughout the tube. Therefore, the ions extracted and accelerated toward the target will react with the gas molecules in order to produce ionisation effects, dissociation effects and charge exchange effects. This results, on the one hand, in a lower mean energy of the ions on the target, that is to say a reduction of the production of neutrons, and, on the other hand, in the formation of ions and electrons which are subsequently accelerated and bombard the ion source or the electrodes of the tube.

This results in energy spots which increase the temperature of electrode materials such as molybdenum or stainless steel or pyrolytic carbon. The heating of these materials causes desorption of impurities such as carbon oxide enclosed in the neutron tube, thus reducing the quality of the tube atmosphere. The ions of impurities formed in the tube, for example $Co^+$, bombard the target with a pulverisation coefficient which is a factor from $10^2$ to $10^3$ higher than that of the deuterium-tritium ions, thus causing an substantial increase of the erosion.

These effects increase as the operating pressure is higher and the ion path is longer. Thus, a correction of the inhomogeneities of the bombardment of the target which could be realised by increasing the ion path is ineffective because of the increase of the ion-gas reactions which is greater than or equal to a simple proportionality factor.

SUMMARY OF THE INVENTION

It is the object of the invention to provide a structure in which these reactions no longer have adverse effects on the operation of the tube. Therefore, prevention of the "return" of the electrons created by the beam ion to the ion source where the electrons would deposit a large amount of energy. Therefore, it is necessary to push these electrons back into the space between the point of convergence and the target where they acquire only a low energy and to collect these electrons on the electrodes bounding this space.

To this end, the invention is characterized in that the acceleration system comprises an additional electrode carrying a potential which limits the re-acceleration of secondary electrons to the source, which secondary electrons, are created by ionisation of the gas along the path the ion beam or beams in the space between the extraction and acceleration system and the target electrode, thus enabling this space to be increased for a substantial reduction of the inhomogeneities of the ion bombardment.

An embodiment of the device in accordance with the invention comprises a final acceleration electrode which is connected to the same potential as the target, with the additional electrode acting as an electron repulsion electrode which carries a negative potential with respect to the final acceleration electrode and having a plane situated in the vicinity of and downstream from the exit plane of the final acceleration electrode in the equipotential space between the acceleration electrode and the target.

In another embodiment, the device in accordance with the invention comprises a final ion acceleration electrode which is connected to a negative potential with respect to the target electrode in order to act as the electron repulsion electrode. The additional electrode is arranged in the vicinity of and downstream from the exit plane of said final ion acceleration electrode and is connected to the same potential as the target. The electrons are collected by the target and the additional electrode.

The devices in accordance with the invention do not lead to a substantial deterioration of the operation of the tube when the space is increased.

The energetic ions loose only very little energy during ionising shocks (in the order of $10^{-4}$) and, during charge exchanges, they are transformed into fast neutrons of the same energy as the incident ion.

The electrons and the ions formed in the space cause only little energy and, considering the potentials of the electrodes, they are captured thereby and the energies deposited are reduced (in the order of 1% of the energy dissipated on the target). The increased length of the space will simply increase the inter-electrode currents (target/acceleration electrode or repulsion electrode/acceleration electrode and target); this will become manifest as a slight degree of heating. These electrodes are, therefore, made of a refractory material.

BRIEF DESCRIPTION OF THE DRAWINGS

The invention will be described in detail hereinafter, by way of example, with reference to the accompanying diagrammatic drawing.

DESCRIPTION OF THE INVENTION

Figure 1:
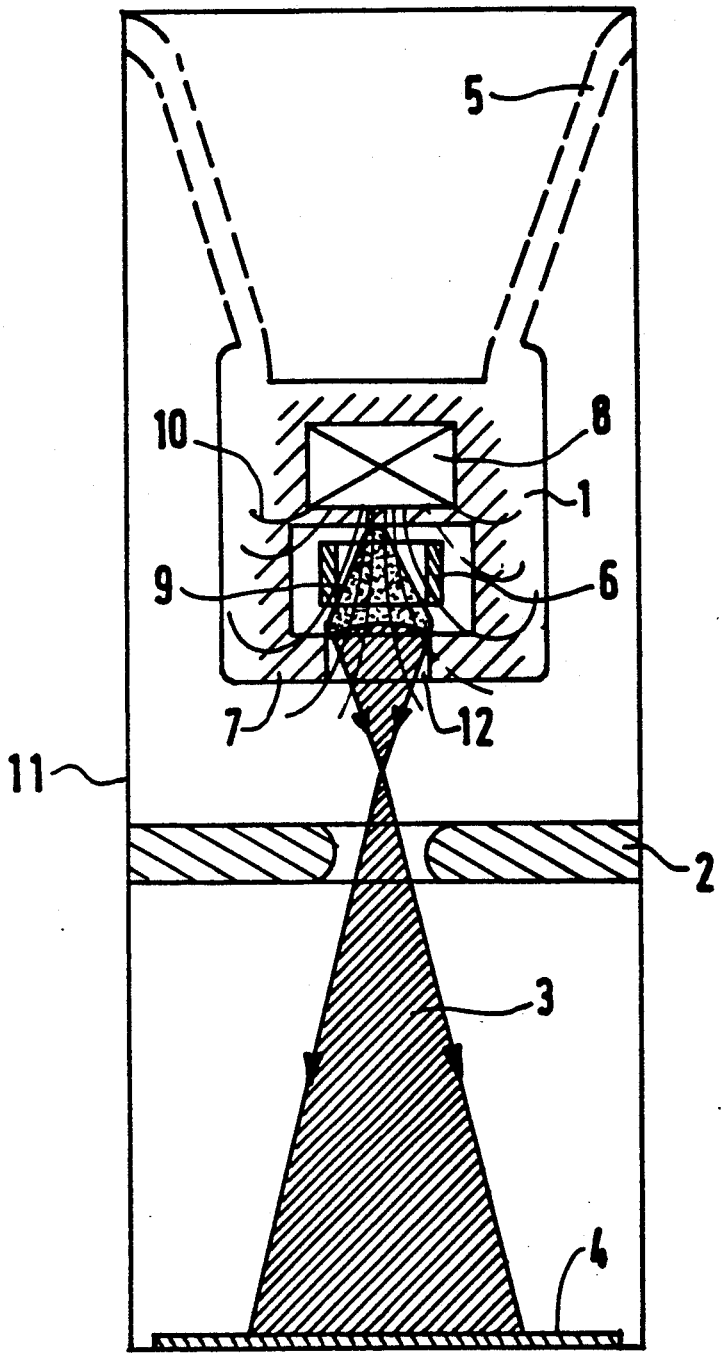
FIG.1 PRIOR ART
FIG. 1 shows the circuit diagram of a prior art sealed neutron tube.

The diagram of FIG. 1 shows the basic elements of a sealed neutron tube 11 which encloses a low pressure gaseous mixture to be ionised, for example deuterium-tritium, and which comprises an ion source 1 and an acceleration electrode 2 wherebetween a very high potential difference exists which enables the extraction and focusing of the ion beam 3 and its projection onto the target 4 where the fusion reaction takes place causing an emission of neutrons of, for example 14 MeV.

The ion source 1 is integral with an insulator 5 for the passage of the high-voltage connector (not shown) and is, for example, a Penning-type source which is formed by a cylindrical anode 6, a cathode structure 7 which incorporates a magnet 8 with an axial magnetic field magnetic field confines the ionised gas 9 to the vicinity of the axis of the anode cylinder and whose lines of force 10 exhibit a given divergence. An ion emission channel 12 is formed in the cathode structure so as to face the anode.

The diagrams of FIG. 2 illustrate the target erosion effects.

Figures 2A, 2B, 2C, 2D:
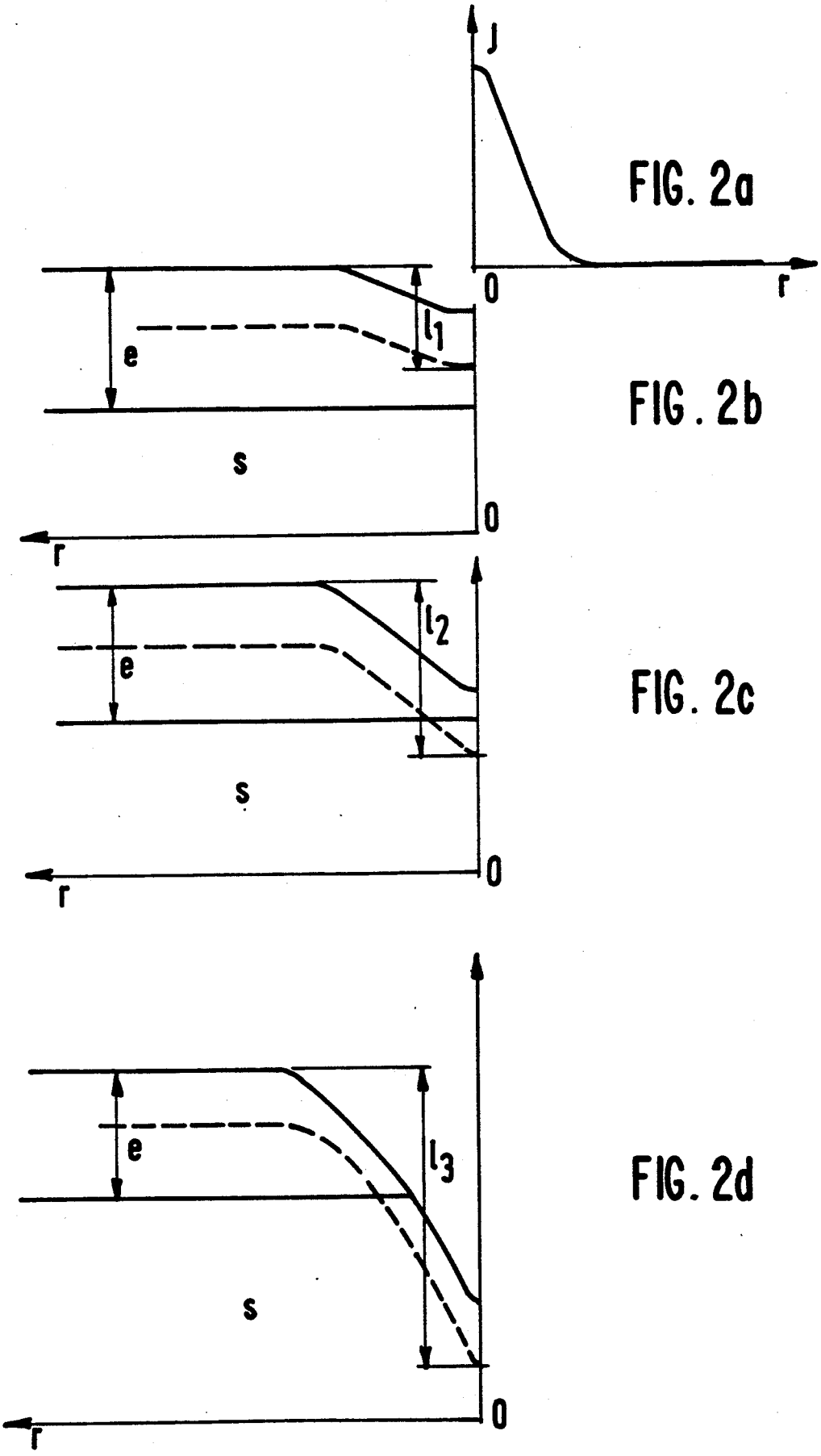
FIGS. 2*a*, 2*b*, 2*c* and 2*d* shows the erosion effects in the depth of the target and the radial ion bombardment density profile.

FIG. 2*a* shows the density profile J of ion bombardment in an arbitrary radial direction Or, starting from the point of impact O of the central axis of the beam on the surface of the target for a standard optical system comprising a single electrode. The shape of this profile illustrates the inhomogeneous character of this beam where the very high density in the central part rapidly decreases towards the periphery.

FIG. 2*b* shows the erosion as a function of the bombardment density and the entire layer of hydride having a thickness e and deposited on a substrate S is saturated with the deuterium-tritium mixture. The penetration depth of the energetic deuterium-tritium ions, denoted by a broken line, equals a depth $l_1$ as a function of this energy.

In FIG. 2*c* the erosion of the layer is such that the penetration depth $l_2$ is greater than the thickness e in the most heavily bombarded zone; a part of the incident ions propagates in the substrate and the deuterium and tritium atoms are very quickly oversaturated.

In FIG. 2*d* the deuterium and tritium ions collect and form bubbles which form craters upon bursting and which very quickly increase the erosion of the target at the depth $l_3$.

The latter process immediately precedes the end of the service life of the tube, causing either a drastic increase of breakdowns (presence of microparticles resulting from the bursting of bubbles) or pollution of the target surface by the pulverised atoms which absorb the energy of incident ions.

Figure 3A:
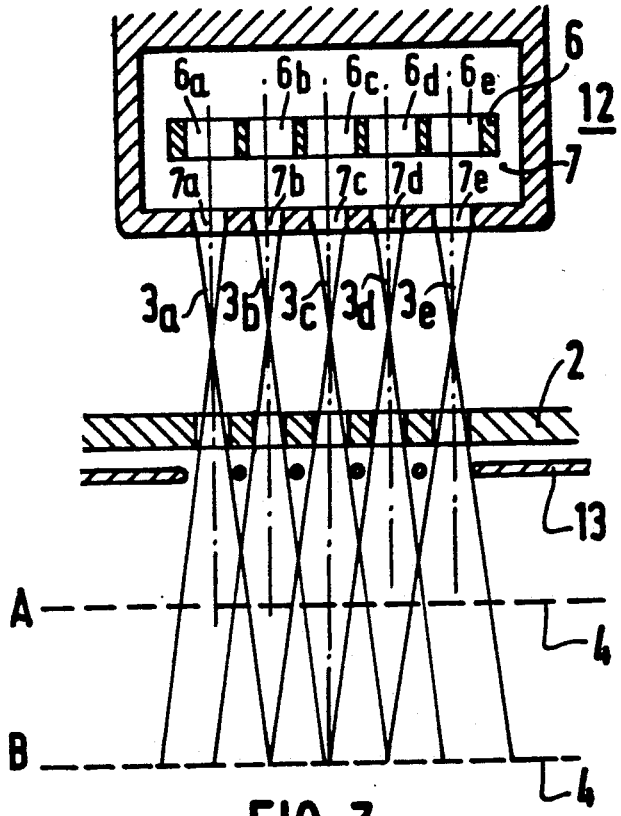
FIG. 3*a*, 3*b* and 3*c* diagrammatically show a first embodiment of the structure of ion-optical elements of the device in accordance with the invention.

FIG. 3*a* diagrammatically shows a neutron tube which comprises a multi-cell multi-beam penning-type ion source 12 whose cylindrical anode 6 is pierced so as to form juxtaposed holes 6*a*, 6*b*, . . . 6*e* and carries a potential which is approximately 4 kV higher than that carried by the cathode 7 which itself is connected to a very high voltage of, for example 250 kV.

The ion beams 3*a*, 3*b*, . . . 3*e* emanating from the emission channels 7*a*, 7*b*, . . . 7*e* formed in the cathode so as to face the corresponding anode holes are projected onto the target 4 by means of the acceleration electrode 2.

The beam section intercepted by the target depends on the divergence of the paths and notably on the distance between the target and the point of convergence.

The diagram of FIG. 3*a* illustrates this property on the basis of a suitable choice of the position of the target.

Figure 3B:
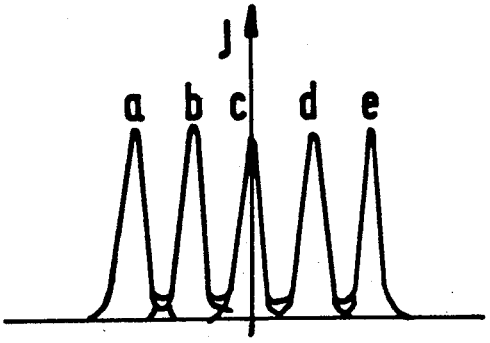

The Figure shows that for the position A the surfaces of impact of the elementary beams on the target are distinct from one another; the density profile J of each elementary beam is as indicated in FIG. 3*b*, i.e. a high axial value and a strong decrease at both sides of the axis.

One way of realising a more homogeneous density distribution at the area of impact of the overall beam on the target is to increase the distance between the target and the source, i.e. moving the target for example from the position A to the position B, so that overlapping of the elementary beams occurs.

Figure 3C:
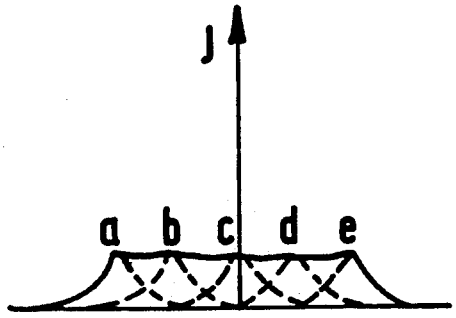

It appears from FIG. 3*c* that the density profile J of each beam on the target is wider and that its axial value is smaller. Moreover, the overlapping of the elementary profiles enables a substantially homogeneous resultant profile to be obtained.

Unfortunately, this ideal result cannot be achieved in practice because of the increased gas ionisation by the ions of the beam when the length of the paths in the space between the target and the accelerator electrode is increased in a prior art structure. Actually, the electrons thus created are re-accelerated in the direction of the source and the electrodes of the tube whose heating causes desorption of impurities and the creation of impure ions such as $Co^+$ whose pulverisation coefficient is from $10^2$ to $10^3$ times higher than that of deuterium ions, thus seriously detiorating the quality of the tube atmosphere. Moreover the secondary electrons emitted by the target in the rhythm of several electrons emerging by incidence of ions and re-accelerated to the source in the same way also contribute to heating and ultimately to destruction of the target.

The device in accordance with the invention enables the secondary electrons emitted by the target as well as those created by ionisation of the gas to be repelled. A first embodiment of this device comprises an additional electrode 13 which carries a suitable potential and which is arranged in the vicinity of the acceleration electrode in the space between this electrode and the target, thus enabling full benefit to be derived from the remoteness of the target. This additional electrode is connected to a negative potential (for example, −5 kV) with respect to that of the acceleration electrode and that of the target which are connected to ground and are made of a refractory material in order to counteract heating by interelectrode currents in the space between the target and the acceleration electrode.

Figure 4:
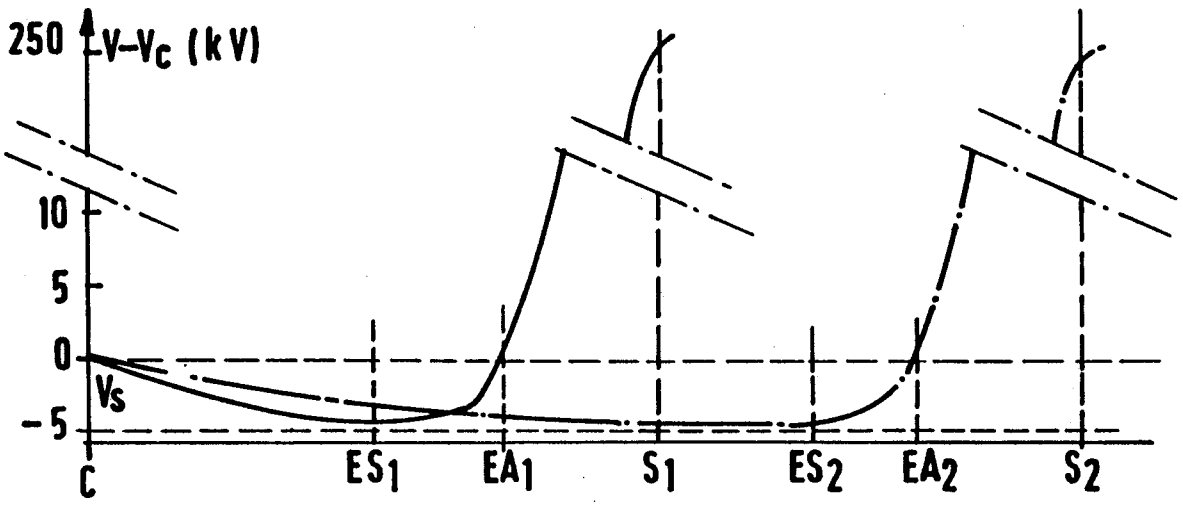
FIG. 4 shows the potential distribution along the axis of the ion beam for the device shown in FIG. 3.

FIG. 4 shows the distribution of the potential along the axis of the ion beam for the device shown in FIG. 3.

Instead of arranging the target further from the ion source, it has been suggested (for the same result) to use a fixed target and to displace the assembly forced by the ion source and the electrons in the opposite direction.

On the abscissa there are plotted the positions of the target C, the suppression electrode ES1, the acceleration electrode EA1 and the source S1 for a given neutron tube configuration, and also the positions of the suppression electrode ES2, the acceleration electrode EA2 and the source S2 for another configuration of the neutron tube, corresponding to a doubling of the space between the target and the acceleration electrode. On the ordinate there is plotted the potential level VS of the suppression electrode. The non-interrupted curves and the dash-dot curves represent the gap between the potential V along the axis of the ion beam and the potential Vc of the target for the two respective configurations. The variations of this potential gap in the zones C-ES1 and C-ES2 and the resultant electric fields produce the "repulsion"effect of the additional electrode whereby the electrons emitted by the target and those created by ionisation are collected by the target. The same potential variations in the ion acceleration zones ES1-S1 and ES2-S2, being identical in the two configurations, show that the operation of the tubes remains the same, the flux of electrons created in this region and accelerated toward the ion source remaining identical.

Figure 5:
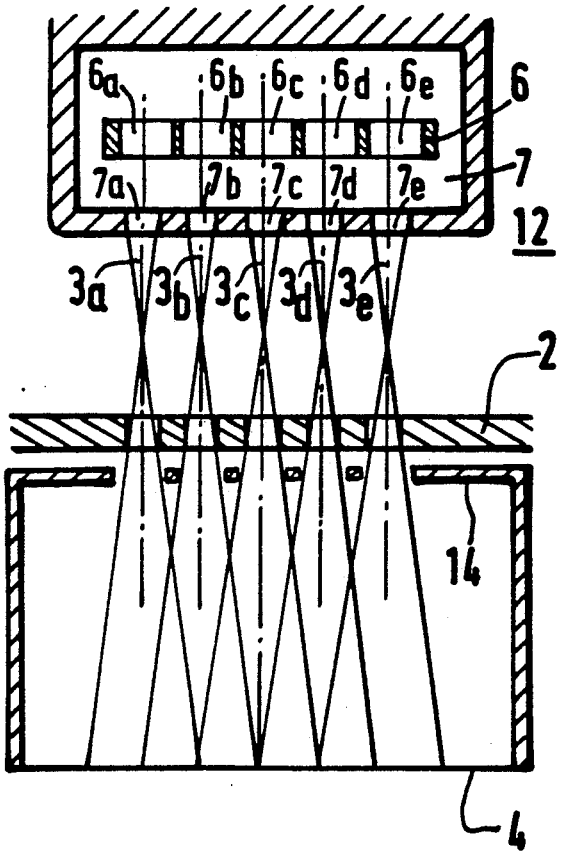
FIG. 5 diagrammatically shows a second embodiment of the structure of ion optical elements of the device in accordance with the invention.

FIG. 5 shows a second embodiment of the device in accordance with the invention in which a target-carrying electrode 14 in the form of wells, or having a structure of holes, which carries the same potential as the target 4 is arranged in the vicinity of the acceleration electrode 2 in the space between this electrode and the target. Repulsion of electrons is achieved by connecting the acceleration electrode 2 to a potential va which is slightly negative with respect to that of the target.

Figure 6:
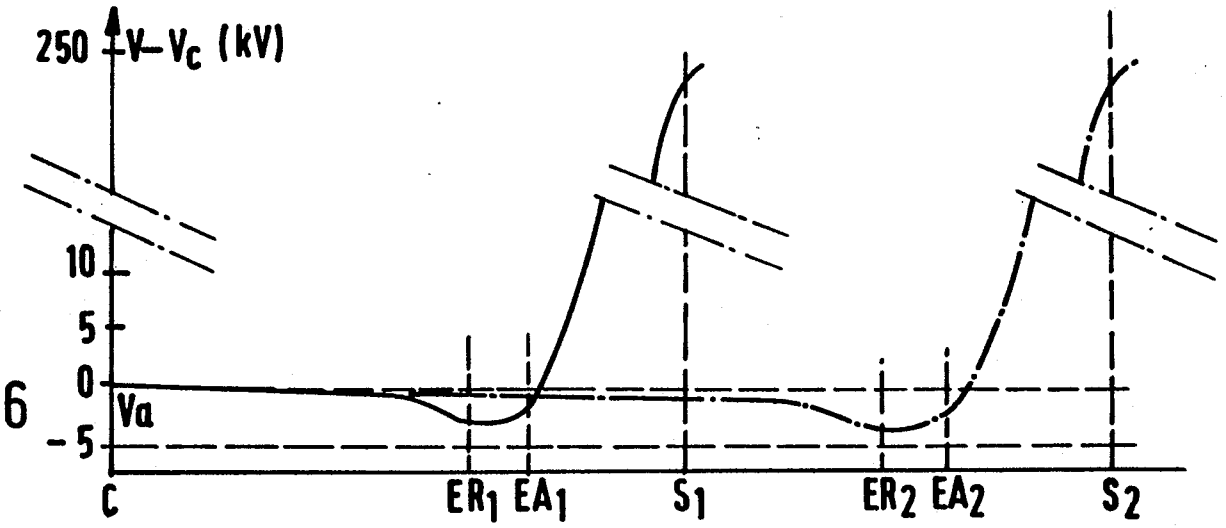
FIG. 6 shows the potential distribution along the axis of the ion beam for the device shown in FIG. 5.

For this second embodiment of the device, the graph of FIG. 6 which is analogous to that of FIG. 4 illustrates the variation of the potential V-Vc along the axis of the ion beam. On the abscissa there are plotted the positions ER1 and ER2 of the edge of the target-carrying electrode placed in the vicinity of the acceleration electrode. The considerations underlying the graph of FIG. 4 are again applicable.

We claim:

1. A device for extracting and accelerating ions in a high flux neutron tube containing a low-pressure gaseous deuterium-tritium mixture, said neutron tube having an ion source supplying at least one ion beam to a target electrode to form a fusion reaction emitting neutrons, said device comprising:

(a) first electrode means for extracting said at least one ion beam and for accelerating said at least one ion beam at a high energy to said target electrode, and (b) additional electrode means coupled with said first electrode means for limiting acceleration of secondary electrons to said ion source, said secondary electrons being created by ionization of gas in a space between said electrode means and said target means, wherein said space is increased to reduce inhomogeneities of ion bombardment of said target electrode, wherein said first electrode means includes a final acceleration electrode to impart a nominal energy to ions of said at least one ion beam, said nominal energy relating to a same potential as said target electrode, and wherein said additional electrode means acts as an electron repulsion electrode carrying a negative potential with respect to said final acceleration electrode, said additional electrode means having a plane situated near an exit plane of aid final acceleration electrode in an equipotential space between said final acceleration electrode and said target electrode.

2. A device according to claim 1, wherein a plurality of ion beams is supplied by said ion source.

3. A device according to claim 1, wherein said additional electrode mans is a refractory conductive material.

4. A device according to claim 1, wherein said final acceleration electrode is a refractory conductive material.

5. A device for extracting and accelerating ions in a high flux neutron tube containing a low-pressure gaseous deuterium-tritium mixture, said neutron tube having an ion source supplying at least one ion beam to a target electrode to form a fusion reaction emitting neutrons, said device comprising:

(a) first electrode means for extracting said at least one ion beam and for accelerating said at least one ion beam at a high energy to said target electrode, and (b) additional electrode means coupled with said first electrode means for limiting acceleration of secondary electrons to said ion source, said secondary electrons being created by ionization of gas in a space between said electrode means and said target means, wherein said space is increased to reduce inhomogeneities of ion bombardment of said target electrode, wherein said first electrode means includes a final acceleration electrode connected to a negative potential with respect to said target electrode, said final acceleration electrode acting as an electron repulsion electrode carrying a negative potential with respect to said additional electrode means and said target electrode, and wherein said additional electrode means is connected to a same potential as said target electrode, said additional electrode means having a plane situated near an exit plane of said final acceleration electrode downstream form said exit plane, said additional electrode means being assembled with said target electrode.

6. A device according to claim 5, wherein a plurality of ion beams is supplied by said ion source.

7. A device according to claim 5, wherein said final acceleration electrode is a refractory conductive material.

* * * * *